United States Patent [19]

Wirz et al.

[11] 4,026,209

[45] May 31, 1977

[54] SHEET-FED ROTARY PRINTING PRESS FOR PRINTING ON BOTH SIDES OF A SHEET

[75] Inventors: Arno Wirz; Willi Becker, both of Bammental; Bernhard Maul, Heidelberg, all of Germany

[73] Assignee: Heidelberger Druckmaschinen Aktiengesellschaft, Heidelberg, Germany

[22] Filed: Oct. 15, 1975

[21] Appl. No.: 622,701

[30] Foreign Application Priority Data

Oct. 16, 1974 Germany ..... 2449122

[52] U.S. Cl. ..... 101/231; 101/410; 271/277

[51] Int. Cl.[2] ..... B41F 21/04

[58] Field of Search ..... 271/82, 277; 101/408–411, 230–232, 246, 141

[56] References Cited

UNITED STATES PATENTS

| | | | |
|---|---|---|---|
| 3,096,088 | 7/1963 | Young | 101/409 |
| 3,430,946 | 3/1969 | Siebke | 271/277 |
| 3,447,800 | 6/1969 | Reinhardt | 271/82 |
| 3,829,084 | 8/1974 | Jurny | 101/230 |
| 3,899,970 | 8/1975 | Jurny et al. | 101/232 |
| 3,937,142 | 2/1976 | Cerny et al. | 101/409 |

*Primary Examiner*—Edgar S. Burr
*Assistant Examiner*—William Pieprz
*Attorney, Agent, or Firm*—Herbert L. Lerner

[57] ABSTRACT

Sheet-fed rotary printing press for printing on both sides of a sheet includes an assembly of a transfer drum, a storage drum and a sheet turn-over drum, mounted in succession, and located between two printing units, the storage drum having clamping grippers for gripping the leading edge of a sheet being fed from the transfer drum to the storage drum, the turn-over drum having tong grippers for gripping the trailing edge of the sheet at an imaginary straight line connecting the rotary centers of the storage drum and the turn-over drum as the sheet is being transferred from the storage drum to the turn-over drum and as the clamping grippers of the storage drum release the leading edge of the sheet, the tong grippers exerting a weaker clamping force on the sheet than the clamping force exerted by the clamping grippers thereon and, before the tong grippers have gripped the sheet and before the clamping grippers have released the sheet, the distance between the clamping grippers, on the one hand, and the tong grippers, on the other hand, is increased.

2 Claims, 7 Drawing Figures

SHEET-FED ROTARY PRINTING PRESS FOR PRINTING ON BOTH SIDES OF A SHEET

The invention relates to a sheet-fed rotary printing press for printing on both sides of a sheet with a transfer drum, a storage drum and a sheet turning or turn-over drum between two printing units, wherein a sheet fed from the transfer drum to the storage drum is gripped at the leading edge thereof by clamping grippers of the storage drum, and wherein the sheet, during transfer thereof from the storage drum to the turn-over drum, is gripped at the trailing edge thereof by grippers of the turn-over drum at an imaginary straight line extending between the rotary centers of the storage and the turn-over drums and the clamping grippers of the storage drum release the sheet at the leading edge thereof.

Such sheet-fed rotary printing presses printing on both sides of a sheet, also known as perfector printing, with three drums between two consecutive printing units are generally known. A both-side sheet imprinting or so-called perfector press is known from German published Non-Prosecution Patent Application DT-OS No. 1,786,371 wherein two consecutive printing units are connected by a turning or turn-over drum. The storage drum in this heretofore known construction has twice the diameter of the turning drum and accordingly also two sheet-guiding surfaces with sheet-holding means associated therewith. This German publication discloses an improvement over a heretofore known row of suction grippers which apply tension to the sheet. It has two functions to perform. For one, it serves to apply tension to the fed sheet by seizing the trailing edge thereof and swinging it through a small angle in a direction away from the grippers. For the other, the row of suction grippers holds the accepted sheet until the clamping grippers of the turn-over drum grip the trailing edge of the sheet.

The disadvantage of the foregoing heretofore known sheet turnover device is that due to the pivotable or swingable row of suction grippers with their respective control mechanisms, additional expense is required. The manufacturing costs as well as the susceptibility to breakdown of the press are thereby increased. It is accordingly an object of the invention to tension a sheet that is to be transferred and to transfer it with retained registry in a sheet-fed rotary printing press with three drums between two consecutive printing units. It is a further object of the invention to achieve simultaneously a uniform weak tension without crease-formation over the entire width of the sheet.

With the foregoing and other objects in view, there is provided in accordance with the invention, in a sheet-fed rotary printing press for printing on both sides of a sheet, an assembly of a transfer drum, a storage drum and a sheet turn-over drum, mounted in succession, and located between two printing units, the storage drum having clamping grippers for gripping the leading edge of a sheet being fed from the transfer drum to the storage drum, the turn-over drum having tong grippers for gripping the trailing edge of the sheet at an imaginary straight line connecting the rotary centers of the storage drum and the turn-over drum as the sheet is being transferred from the storage drum to the turn-over drum and as the clamping grippers of the storage drum release the leading edge of the sheet, the tong grippers exerting a weaker clamping force on the sheet than the clamping force exerted by the clamping grippers thereon and, before the tong grippers have gripped the sheet and before the clamping grippers have released the sheet, the distance between the clamping grippers, on the one hand, and the tong grippers, on the other hand, is increased.

Within an additonal travel path beyond an imaginary line extending from the center of rotation of the storage drum to that of the turn-over drum, wherein the sheet is held at the leading and the trailing edges thereof, it is subjected to tension due to the differences in the travel paths of the grippers of the storage drum and of the turn-over drum. After the sheet has attained its required tension it continues to be drawn out from between the gripper members of the grippers of the turn-over drum until it has attained a registry-retaining or correct registry position. After the clamping grippers of the storage drum have opened, the sheet is conducted in this fixed registry position to the next printing unit for imprinting the unprinted second side of the sheet or for perfecting.

The invention thus requires for applying tension to and aligning or orienting a sheet no further means than the gripper devices that are already available in any case. Thereby, the position of the leading edge of the sheet oriented in proper registry is maintained without change for the further transfer thereof through the press.

In accordance with another feature of the invention, means are provided for increasing the clamping force of the tong grippers after the clamping grippers have opened and released the sheet. A result thereof is that the sheet to be transported is securely held even at high machine operating speeds.

Tong grippers are employed for carrying out the invention of the instant aplication, however, other types of gripper devices may also find ready application in the invention described herein.

Other features which are considered as characteristic for the invention are set forth in the appended claims.

Although the invention is illustrated and described herein as embodied in sheet-fed rotary printing press for printing on both sides of a sheet, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
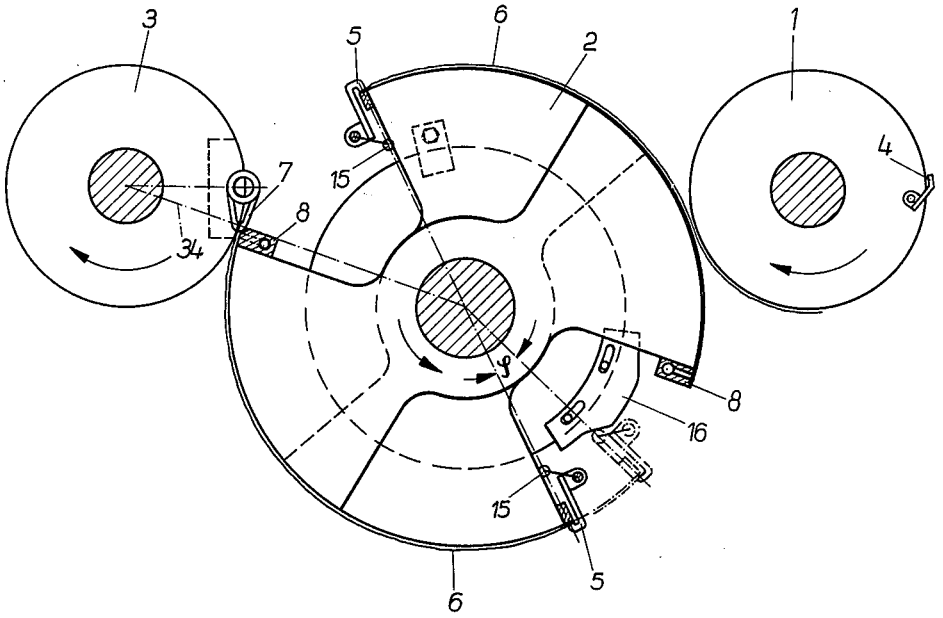
FIG. 1 is a diagrammatic side elevational view of the transfer, storage and sheet turn-over drums according to the invention of a sheet-fed rotary printing press which prints on both sides of a sheet.

Referring now to the drawing and first, particularly, to FIG. 1 thereof, there are shown three drums 1 to 3 assembled for transferring imprinted sheets from one to another non-illustrated printing unit of a sheet-fed rotary printing press.

Of the three drums 1 to 3, a transfer drum 1 accepts or takes over a sheet 6 that has been imprinted on one side thereof from a preceding non-illustrated printing unit, surrenders it to a storage drum 2 having substantially twice the diameter of that of the transfer drum 1, and the storage drum 2, in turn, surrenders the sheet 6 to a turning or turn-over drum 3 in a manner that the side of the sheet 6 that had not been imprinted lies face up on the turn-over drum 3 which, thereafter, delivers the sheet 6 to a non-illustrated succeeding printing unit in the thus turned-over position of the sheet 6 for printing on or perfecting the as yet unprinted side of the sheet 6. In the course of the transfer of the sheet 6 from the one to the other non-illustrated printing unit, the sheet 6 is seized by a row of conventional grippers 4 mounted on the transfer drum 1 and is then transferred to conventional clamping grippers 5 mounted in a channel suitably provided in the storage drum 2 at the instant the gripers 5 are located in an imaginary straight line 34 extending from one center to the other of the drums 3 and 2. The clamping grippers 5, in turn, hold the sheet 6 firmly at the leading edge thereof until the trailing edge thereof reaches the imaginary straight line 34 extending from one center to the other of the storage and the sheet turn-over drums 2 and 3 at the instant a row of tong grippers 7 on the turn-over drum 3 is located at the line 34 between the centers of the drums 2 and 3. Thus, at the latter location, the sheet 6, as viewed in rotary direction of the storage drum 2 is seized at the trailing edge thereof by the tong grippers 7 of the turn-over drum 3 and is transferred in turned-over condition to the non-illustrated succeeding printing unit.

So that the sheet 6 should not drop from the storage drum 2 when it is located along a lower region thereof during slow running of the press, the trailing end of the sheet 6 is held fast by a suction bar 8 until that end of the sheet 6 is taken over by the tong grippers 7.

Figure 2:
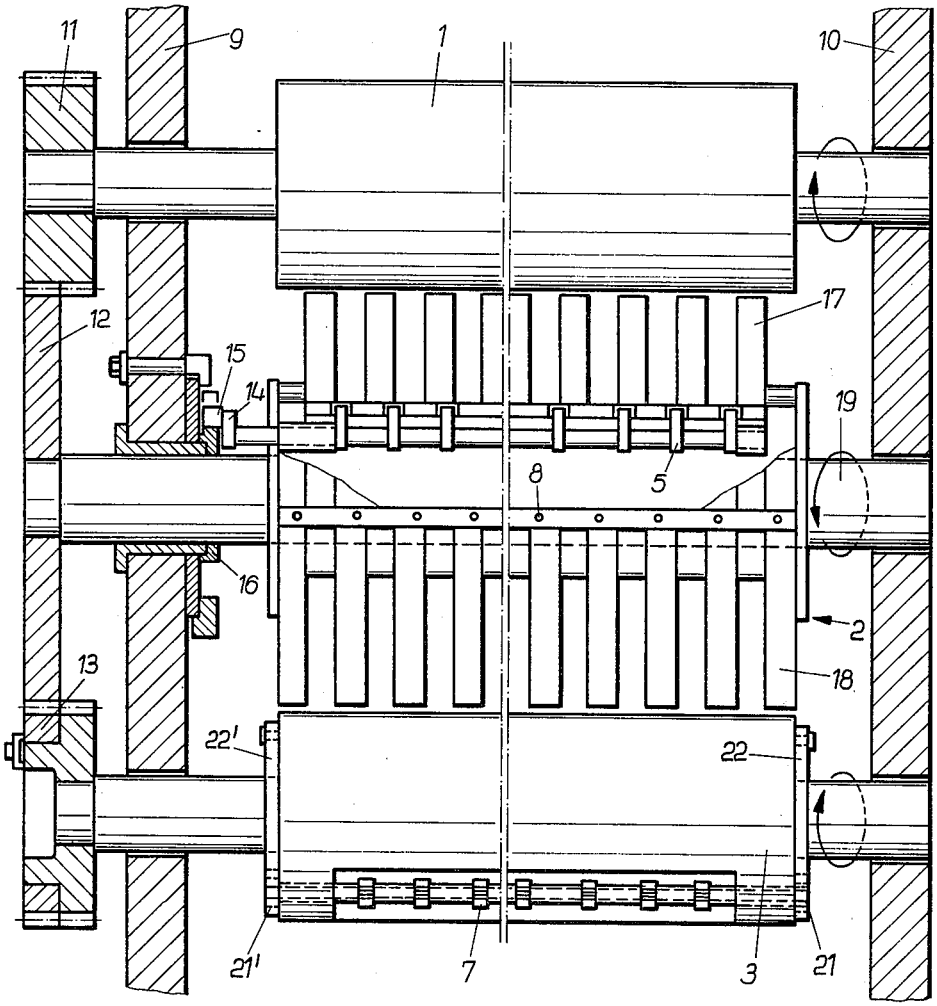
FIG. 2 is a top plan view of FIG. 1, partly in section and rotated 90° in counterclockwise direction.

FIG. 2 shows how the drums 1 to 3 are mounted in side frames 9 and 10. The drums 1 to 3 are driven through respective spur gears 11, 12 and 13. The clamping grippers 5 of the storage drum 2 are controlled by a cam 16 for opening the grippers 5 through a lever 14 and a roller or cam follower 15.

Figure 3:
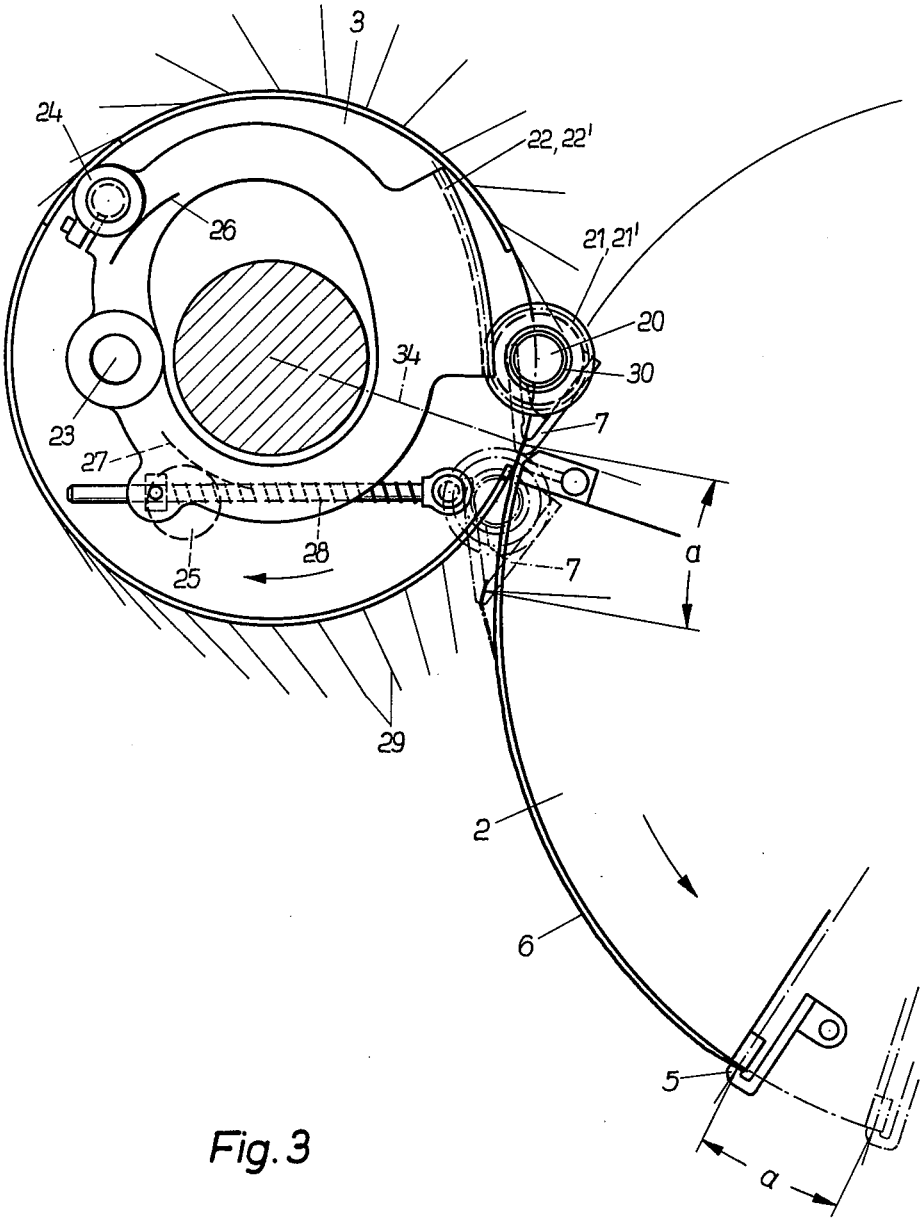
FIG. 3 is an enlarged fragmentary view of FIG. 1 showing the storage and turn-over drums in greater detail especially at the sheet transfer location thereof.

In the illustrated embodiment of the invention, as shown in FIG. 2, the storage drum 2 is formed of individual rows of segments 17 and 18, which are pivotable relative to one another. The peripheral length of the outer surface of the storage drum 2 is thereby adjustable in accordance with the respect sheet format. The respective rows of segments 17 and 18 are mounted on a drum shaft 19. FIG. 3 shows how the tong grippers 7 are controlled in the sheet turning or turn-over drum 3. A gripper spindle 20 mounted on the turn-over drum 3, as shown, also, in FIG. 2, carries one tong member of each of the tong grippers 7 and receives its rotary motion through a gear 21 from a toothed segment 22 meshing therewith, and a hollow shaft 30 coaxially surrounding the gripper spindle 20 carries the other tong member of each of the tong grippers 7 and receives its rotary motion through a gear 21′ mounted on the hollow shaft 30 from a toothed segment 22′, both the gear 21′ and the toothed segment 22′ being located at an end of the turn-over drum 3 opposite to the end thereof at which the gear 21 and the toothed segment 22 are located (note FIG. 2, especially). The toothed segments 22 and 22′ pivot about the pivot shaft 23 and are controlled by rollers or cam followers 24 and 25 through respective cams 26 and 27. As shown in FIG. 3, a spring 28 biases the roller or cam follower 24 into rolling engagement with the cam 26. On the other end of the turn-over drum 3, the gear 22′ with the roller 25, the cam 27 and another spring like the spring 28 are mounted in mirror-immage relationship to the corresponding members shown is solid lines in FIG. 3.

In accordance with the invention, the clamping grippers 5 of the storage drum 2 grip the sheet 6 until the trailing edge thereof has been carried a given distance beyond the imaginary line 34 between the rotary centers of the storage and the turn-over drums 2 and 3. The sheet measurement *a* is consequently adjustable by displacing the cam 16 which opens the grippers 5 (FIG. 1) in accordance with the evenness or smoothness of the material to be processed. When the sheet 6 is transferred from the storage drum 2 to the turning drum 3, it is gripped at the trailing edge thereof by the tong grippers 7 of the turning drum 3 in the imagenary line 34 extending from the one to the other centers of rotation of the drums 2 and 3. The sheet 6 from that moment on is held by grippers at the leading and trailing edge thereof. Due to the different paths traversed by the mountings of the grippers 5 and 7 in accordance with the rotation of the drums 2 and 3 and the pivoting of the tong grippers 7, tensioning of the sheet 6 is initially produced. Waves are formed in the sheet caused by inner tension forces in the sheet. These waves are not uniform and depend on the material of sheets and also on differences in the humidity content of the sheet. Due to the non-uniform formation of waves in the sheet 6, the measurement or measured value necessary therefor to smooth out the waves is not constant. After being subjected to tensioning, the sheet 6 slides out from between the gripping members of the tong grippers 7 until the clamping grippers 5 have traversed the distance *a* (FIG. 3) and then release the leading edge of the sheet 6. Thereafter, the tong grippers 7 travel further in clockwise direction in accordance with the rotation of the turn-over drum 3 and, at the same time, pivot backwardly i.e. counterclockwise, in accordance with the positions represented by lines 29. After the pivoting motion of the tong grippers 7 has been completed, at the left-hand side of the turn-over drum 3 as shown in FIG. 3, the sheet 6 is then surrendered in turned-over condition ot the non-illustrated succeeding printing unit.

During the aforedescribed sheet transfer, the tong grippers 7 exert a considerably weaker holding force on the sheet 6 than do the clamping grippers 5. Assurance is thereby reliably provided that the sheet 6 will maintain the registry-retaining position thereof in the clamping grippers 5. In accordance with a particularly advantageous embodiment of the invention, the tong grippers 7 of the turnover drum 3 are controlled in such a way that the holding force theereof is increased after the clamping grippers 5 of the storage drum 2 have opened. This is achieved through a corresponding construction of the cams 26 and 27.

Figure 4:
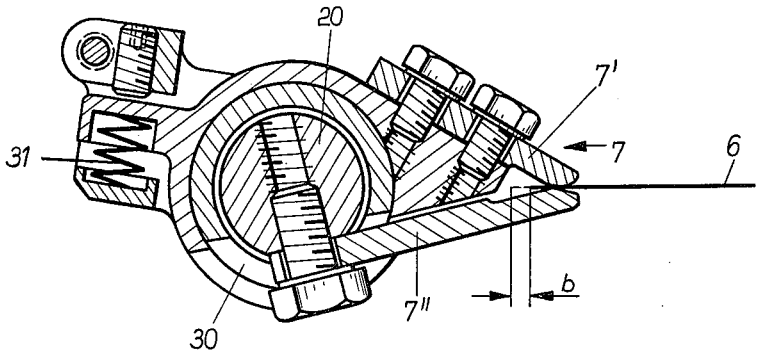
FIG. 4 is an enlarged cross-sectional view of a fragment of FIG. 1, showing a tong gripper of the turn-over drum gripping a sheet that is in tension.

FIG. 4 shows the construction of the tongs grippers 7 which is formed of an upper gripper member 7′ and a lower gripper member 7″, as viewed in FIG. 4. The sheet 6 is held between the gripper members 7′ and 7″. The upper gripper member 7′ is secured on the hollow shaft 30 and the lower gripper member 7″ on the gripper spindle 20. Both of the gripper supports, namely the hollow shaft 30 and the gripper spindle 20 are relatively rotatable for opening and closing the tongs grippers 7 i.e. for pivoting the respective gripper member 7′ and 7″ away from and toward on another, and both the hollow shaft 30 and the gripper spindle 20 are rotatable in common for pivoting the clamping grippers 7 in their entirety i.e. both of the gripper members 7′ and 7″ in unison. Gripper pressure is provided by means of a spring 31. The stretch or distance that the sheet 6 is drawn out from between the gripper member 7′ and 7″ of the tongs grippers 7 when the sheet 6 is subjected to tension is identified by the reference character *b*. It is noted, however, that the distance *b* is not a constant measurement.

Figure 5:
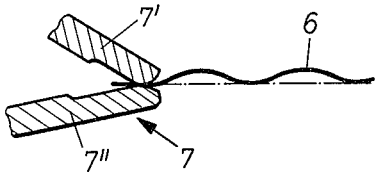
FIG. 5 is a fragmentary view of the gripping tong of the tongs grippee of FIG. 4 which are, however, gripping a sheet that is not subjected to tension.

FIG. 5 shows the tips of the members 7′ and 7″ of the tong grippers 7 gripping a wave-shaped sheet 6.

Figure 6:
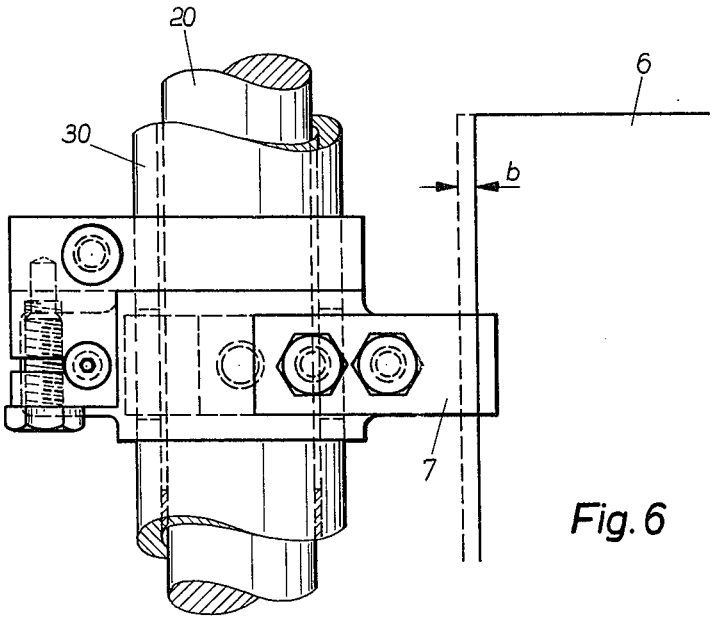
FIG. 6 is a top plan view of FIG. 4.

The plan view of FIG. 6 also shows a tongs gripper 7 with a sheet 6 that has been withdrawn the distance *b*. In this case, the withdrawn position of the sheet 6 shown in solid lines is the registry-retaining position in which the sheet 6 is give over to the succeeding non-illustrated printing unit.

Figure 7:
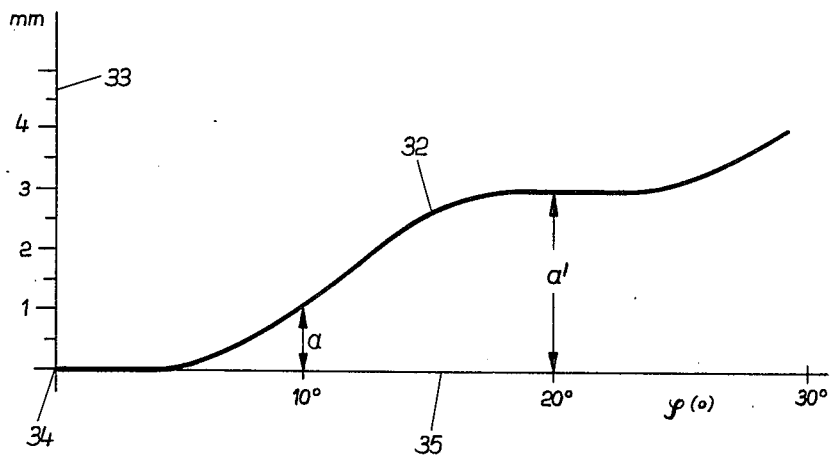
FIG. 7 is a plot diagram of the course of tensioning of a sheet or the difference in travel between the clamping and the tong gripper.

The curve 32 in the graph of FIG. 7 shows the difference in the travel paths between the clamping grippers 5 and the tongs grippers 7 while they grip the sheet 6 at the leading and trailing edges thereof, respectively. This difference in travel paths is produced because the mountings or supports for both sets of grippers 5 and 7 move away from one another in accordance with the rotary motion of the respective drums 2 and 3 and because of the additional pivoting motion of the tongs grippers 7. The respective millimeter scale or measurements are provided along the ordinate 33 in FIG. 7. The zero point is represented by the imaginary line 34 in FIGS. 1 and 3 between the centers of rotation of the storage drum 2 and the turn-over drum 3, the sheet 6 being taken over or accepted thereat by the tong grippers 7. The degrees of the angle $\phi$ i.e. the angles of rotation of the storage drum 2, are provided along the abscissa 35, in accordance with the difference in the travel paths. If the leading sheet end and accordingly the clamping gripper 5, for example, travel onward 10° additionally, then the travel difference *a* is obtained for the respective diameter of the storage drum 2. If the angle $\phi$ should be 20°, then the difference of travel is increased in accordance with the curve 32 to *a*′. The variation or modification in the angle $\phi$ and thereby in the instant at which the opening of the grippers 5 occurs, is effected, as mentioned hereinbefore, by suitably displacing the cam segments 16 (FIG. 1) in peripheral direction.

As is readily apparent from the curve 32, at approximately 20° of the angle $\alpha$, the velocities of both sets of grippers 5 and 7 are substantially the same for a short distance of travel. In actual practice, the clamping grippers 5 normally open in this range. Only if, for example, extremely thin paper is being processed, can an adjustment to a shorter tensioning travel path be necessary.

We claim:

1. In a sheet-fed rotary printing press for printing on both sides of a sheet, an assembly of a transfer drum, a storage drum and a sheet turn-over drum mounted in succession and located between two printing units, clamping grippers on said storage drum for gripping the leading edge of a sheet being fed from the transfer drum to the storage drum, means for exerting a clamping force by said clamping grippers, tong grippers on said turn-over drum for gripping the trailing edge of the sheet at an imaginary straight line connecting the rotary centers of the storage drum and the turn-over drum as the sheet is being transferred from the storage drum to the turn-over drum and as the clamping grippers of the storage drum release the leading edge of the sheet, means for exerting a clamping force by said tong grippers that is weaker than the clamping force exerted by the clamping grippers yet strong enough to overcome the tension forces in the sheet tending to produce waves therein, means for rotating said turn-over drum and said storage drum in opposite directions and moving said tong grippers gripping the trailing edge of said sheet away from said clamping grippers gripping said leading edge of said sheet thereby tensioning said sheet between said tong grippers on said turn-over drum and said clamping grippers on said storage drum so as to smooth out any waves produced in the sheet, to and permitting said sheet to undergo a predetermined amount of sliding movement relative to said tong grippers while gripped thereby.

2. Sheet-fed rotary printing press according to claim 1 including means for increasing the clamping force of the tong grippers after the clamping grippers have released the sheet.

* * * * *